US005580263A

United States Patent [19]

Kourimsky

[11] Patent Number: 5,580,263

[45] Date of Patent: Dec. 3, 1996

[54] MAGNET VALVE CONNECTOR

[75] Inventor: Friedrich J. A. Kourimsky, Bensheim, Germany

[73] Assignee: The Whitaker Corporation, Wilmington, Del.

[21] Appl. No.: 236,770

[22] Filed: May 2, 1994

[30] Foreign Application Priority Data

Jun. 28, 1993 [GB] United Kingdom ..... 9313283

[51] Int. Cl.[6] ..... H01R 13/64

[52] U.S. Cl. ..... 439/248; 439/34; 303/113.1

[58] Field of Search ..... 439/34, 247, 248, 439/449, 456, 457, 271, 272, 274; 137/351, 353, 884; 303/113.1, 119.1

[56] References Cited

U.S. PATENT DOCUMENTS

| | | | |
|---|---|---|---|
| 4,545,635 | 10/1985 | Bunnell | 439/49 X |
| 5,022,717 | 6/1991 | Heibel et al. | 439/34 X |
| 5,137,455 | 8/1992 | Moerbe et al. | 439/34 |

FOREIGN PATENT DOCUMENTS 1455182 11/1976 United Kingdom .

*Primary Examiner*—Khiem Nguyen
*Attorney, Agent, or Firm*—Driscoll A. Nina

[57] ABSTRACT

An electrical connector assembly for electrical connection to an electromagnetic valve assembly subject to large amplitude vibratory movements, comprises a casing and a plurality of connectors mounted thereto via spring means. The connector assembly also comprises a cover and a sealing member therearound whereby the casing, connectors, seal and cover can be assembled together as a single unit which is then matable to the magnet valve assembly comprising a plurality of corresponding magnet valves mounted in a casing. When the connector assembly and the valve assembly are mated together, the connectors are pushed against the valves with a sufficient spring force to ensure that during large vibratory movements, terminals of the magnet valve mated with the terminals of the connector do not move relative to each other in order to avoid fretting corrosion and fatigue thereof.

10 Claims, 2 Drawing Sheets

MAGNET VALVE CONNECTOR

BACKGROUND OF THE INVENTION

1. Field of the Invention

This invention relates to an electrical connector assembly for electrical connection between conducting wires and an electromagnetic valve mechanism, and in particular a connector assembly that prevents fretting corrosion between terminals thereof and the terminals of an electrical device having large amplitude vibratory movements such as antilock braking system magnet valves.

2. Description of the Prior Art

Fretting corrosion is a common problem in electrical connectors especially in an automobile due to the abundance of vibrations. In order to overcome fretting corrosion between mating contacts of terminals, a terminal has been developed as described in European patent application publication 0492479 whereby the terminal contact is attached to the wire connection portion via a spring section that is very supple in the longitudinal direction, thus allowing the wire and terminal contact section to vibrate relative to the contact section which stays in a fixed mating relationship to a mating terminal. The latter solution works very well with vibrations of reasonable amplitude but may not work as effectively with large amplitudes of movement. This occurs for, example, during the functioning of electromagnetic antilock braking system valves, whereby during actuation of the valve, there are rapidly succeeding shock movements that may vibrate the magnet valves with amplitudes of around one millimeter. Such large amplitudes, may not only cause fretting corrosion of the contacts, but may also cause rupture of the terminals by cyclic fatigue. The functioning of antilock braking system valves must be very reliable as it relates to the security of people.

These electromagnetic valves are often standard parts that are supplied by different manufacturers than those of the electrical connectors, which usually means that the electrical connectors must be adapted to conform with the available magnet valves.

It would be desirable to provide a connector assembly that can be assembled at one location and then mounted to the magnet valves at another location. The latter would be particularly advantageous as it would allow the connector assembly to be manufactured in a semi automated or fully automated procedure and supplied as a complete assembly to the automobile manufacturer. In such a procedure, costs would not only be reduced, but the assembly could also be made in a more reliable manner as the connector assemblies could be individually tested at their site of manufacture.

It would also be desirable to produce an assembly that is located within a sealed casing that prevents dirt or liquid ingress into the contact areas in a cost effective and reliable manner.

SUMMARY OF THE INVENTION

It is therefore an object of this invention to provide a cheap and reliable connector system that can support large amplitude vibrations.

It is a further object of this invention, to provide a connector assembly that can be produced and fully assembled at one location and mounted to an electrical device assembly at another location in a rapid and simple manner.

It is also an object of this invention to provide a cheap and reliable sealed electrical connection between an electrical device and a connector assembly.

The objects of this invention have been achieved by providing an electrical connector for connection to an electrical device, the electrical connector mountable to the device and securely holdable thereagainst by spring means, whereby the spring force is greater than the total frictional force between mating device and connector contacts.

Other objects of this invention have been achieved by providing an electrical connector assembly comprising a casing to which the connectors are mounted by spring means, and a cover mounted to the casing whereby the assembly is a single unit that can be coupled to a single unit electrical device such as a magnet valve assembly comprising a casing and a corresponding number of magnet valves.

Other objects of this invention have been achieved by providing an electrical connector as above, that is adapted for insulation displacement connection to conducting wires.

DETAILED DESCRIPTION OF THE PREFERRED EMBODIMENT

Figure 1:
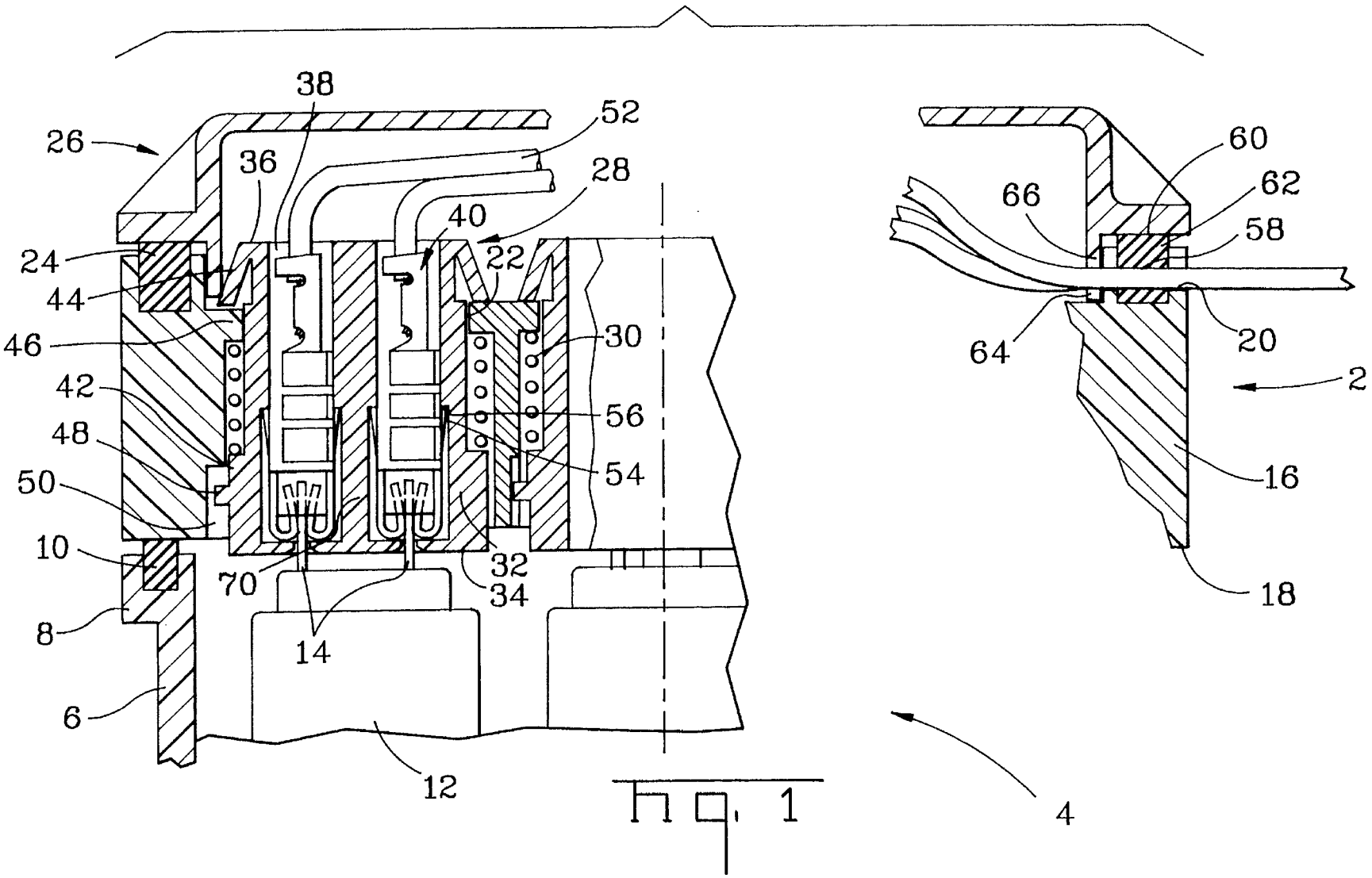
FIG. 1 is a cross sectional view through an electrical connector assembly connected to a partially shown magnet valve assembly.

Referring to FIG. 1, an electrical connector assembly generally shown at 2 is assembled to a magnet valve assembly generally shown at 4. The magnet valve assembly 4 comprises a casing 6 having a rim 8 with a sealing member 10 thereon, and magnet valves 12 having each a pair of electrical tab terminals 14.

The electrical connector assembly comprises a casing 16 having a magnet valve receiving face 18, a wire receiving face 20 and connector receiving cavities 22 extending therebetween, a sealing member 24 mounted around the periphery of the wire receiving face 20, a cover 26 fixable over the wire receiving face, and a plurality of electrical connectors 28 mounted via springs 30 in the cavities 22.

The electrical connector 28 comprises a housing 32 having a mating face 34, a terminal receiving face 36 and terminal receiving cavities 38 extending therebetween, and also comprising receptacle terminals 40 matable with the tab terminals 14 of the magnet valves 12. The connector housing 32 also comprises a spring abutment shoulder 42 therearound and integral resilient retention lances 44.

In order to assemble the connectors 28 to the casing 16, the coil spring 30 is either mounted within the casing cavity 22 against a shoulder 46 thereof at the terminal receiving side 20, or around the connector housing 32 such that it abuts the shoulder 42 thereof. The connector housing 22 can then be inserted into the cavity 32 with the terminal receiving face 36 of the connector housing 32 first being inserted at the mating face 18 of the casing. A polarizing lug 48 on the connector housing cooperates with a slot 50 in the casing 16 to position and prevent rotation of the connector 28 therein. The connector 28 is inserted until the resilient lances 44 are inserted past the shoulder 46 whereby they resiliently bias outwards therepast, thereby retaining the connector in the cavity 22, particularly in opposition to the spring 30 which in this position is slightly compressed thus pushing the lances 44 against the casing shoulder 46. Terminals 40 crimped to conducting wires 52 can then be inserted into the terminal receiving cavities 38, the terminals 40 being retained by locking lances 54 abutting against shoulders 56 within the cavities.

In order to avoid individually sealing each terminal 40 within the cavities 38 and also sealing the wire receiving face 20 from the mating face 18, the seal 24 is provided around the rim of the casing. The seal 24 is provided with wire receiving (cavities) holes 58 that are joined to the cover mating side 60 of the seal via a thin slit 62 that the wire resiliently biases apart when being inserted therethrough into the wire receiving (cavities) holes 58. On closing the cover 26 over the terminal receiving face 20 of the casing 16, the seal 24 is compressed in such a manner that the slits 62 compress tightly together, and the wire receiving (cavities) holes 58 compress around the wires 52 such that the connectors 28 are tightly sealed from the exterior. The cover 26 is also provided with V-shaped slots 64 having a knife edge profile 66 that digs into the wires 52 for retention thereof against a pulling force on the wire 52 from the exterior. The cover 26 can then be secured by some well known latching means available in the prior art such that it is pressed tightly against the sealing member 24.

The connector assembly 2 as described above, can thus be manufactured and assembled at a location different to that of the magnet valve assembly 4. The magnet valves 12 are disposed within the casing 6 in such a manner as to receive the connector assembly 2 whereby the tab terminals 14 of the magnet valves 12 are upstanding for reception of the connector assembly receptacle terminals 40. During mating of the connector assembly 2 to the magnet valve assembly 4, stopping means 70 of the connector housing 32 abut the magnet valves when the tab terminals 14 are fully inserted into the terminals 40, whereby further mating of the magnet valve assembly 4 towards the connector assembly 2 causes the magnet valve 12 to push against the connector housing 32 and resiliently bias the connector 28 against the spring 30, thereby further compressing the spring. In the fully assembled position, the valve casing 6 can be latched to the connector casing 16 via a well known latching mechanism (not shown) whilst compressing the seal member 10 that is disposed around the periphery of the casing therebetween. The connector 28 thus abuts the magnet valve with a compression spring force, whereby this compression spring force must be greater than the frictional force of the mating terminals 14 and 28 so as to ensure that the connector 28 is always abutting the magnet valve 12. Were the spring force to be less than the frictional force, a strong inertial force might cause the connector 28 to move away from the magnet valve 12 whereby it would not return thereagainst because the frictional force would be greater than the returning spring force. Further inertial forces however could cause the connector 28 to be pushed back against the magnet valve 12. This movement however would be undesirable and defeat the object of this invention.

The magnet valves 12 serve, for example, to prevent locking of an automobiles wheels during braking. If a wheel suddenly stops rotating, the magnet valves are actuated, opening and closing the valves in rapid succession to release the brake fluid pressure of the brake discs thus unlocking the wheels. This rapid succession of opening and closing the valves creates large mechanical shocks to which the magnet valves are subject, whereby the magnet valves 12 may vibrate with amplitudes of around one millimeter. The terminals 40 which could be similar to those disclosed in European patent application 0492479 are designed to avoid fretting corrosion for a certain level of vibration, however the large amplitudes created by the magnet valves cannot be absorbed and might either cause fretting corrosion or fatigue rupture of the terminals 40. By butting the connector housing 32 against the magnet valve 12 with a sufficient spring force, one thus ensures that the connector housing 32 moves with the magnet valve 12 thereby eliminating relative movement between the magnet valve terminals 14 and the connector terminals 40, contrary to a situation whereby the connector housing 32 is fixed to the casing 16.

Advantageously therefore, the above connector assembly eliminates fretting corrosion and/or fatigue rupture of mating terminals that are subject to large vibratory amplitudes.

Advantageously also the connector assembly 2 can be assembled as a separate single unit at a separate location to that of the magnet valve assembly 4 and then rapidly and simply mated thereto, the assembled magnet valve assembly and connector assembly being sealed off from the exterior.

Figure 2:
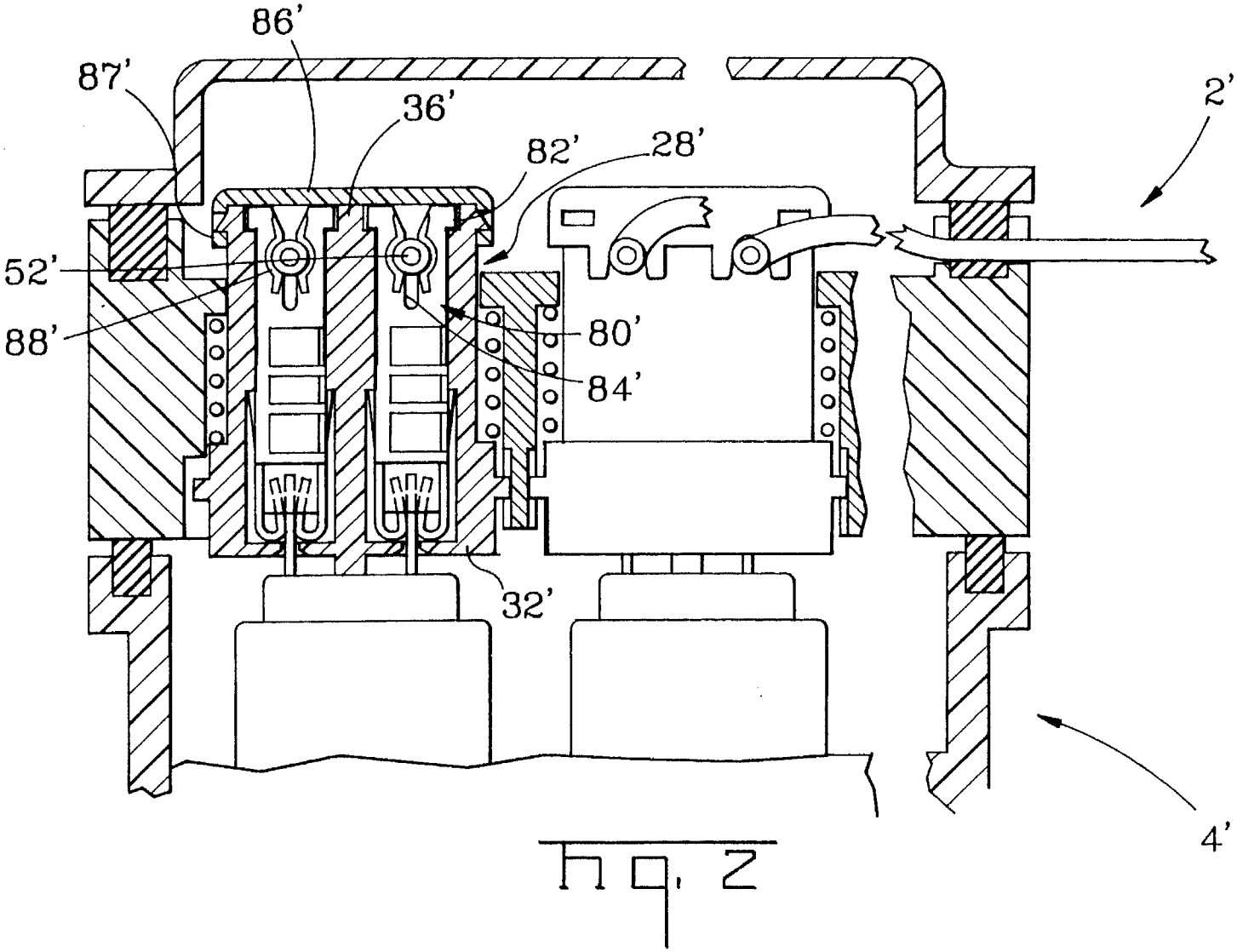
FIG. 2 is a cross sectional view of another embodiment of an electrical connector assembly connected to a partially shown magnet valve assembly.

Referring now to FIG. 2, another embodiment is shown, whereby many aspects are similar to that of the embodiment of FIG. 1 except for the terminal wire connecting construction. All similar features to those of the embodiment shown in FIG. 1 will be denoted with the same number but with a prime. The terminals 40 of the embodiment of FIG. 1 are simply crimped to the conducting wires 52 and then inserted into the cavities 38 of the connector housing 32. In the embodiment of FIG. 2, the terminals 80' comprise an insulation displacement wire contacting section 82' having an insulation displacement slot 84'. The connector 28' comprises a cover 86' that is latchably received over the terminal receiving end 36' of the connector. The cover 86' has wire holding clips 88' integrally molded thereon that serve to provisionally hold the conducting wires 52' and stuff them into the insulation displacement slots 84' for electrical contact therewith. The wires 52' are thus electrically connected to the terminals 80' by first clipping the wires to the wires clips 88' of the cover 86' and then simply closing the cover over the connector housing 32' until the latching means 87' engage. In this embodiment, the terminals 80' can thus be mounted to the connector housing 28' separately from the wires 52' and the wires 52' can be rapidly and simply connected to the terminals by clipping them onto the cover without requiring any special preparation of the wire ends. All other features and assembly steps are similar to those described in the embodiment of FIG. 1.

I claim:

1. An electrical connector assembly for electrical connection to an electrical device assembly subject to vibration, the electrical connector assembly comprising a casing and a plurality of electrical connectors each having an insulative housing with electrical terminals mounted therein, each of the connectors being mounted to the casing via a spring, the plurality of electrical connectors being mountable to the electrical device assembly and securely holdable thereagainst such that each of the insulative housings abut the electrical device assembly whereby the spring force is greater than the total frictional force between the mating electrical device assembly and connector terminals.

2. The electrical connector of claim 1 characterized in that each electrical connector is mountable to the connector casing and securely holdable thereto via retention means, the retention means comprising resilient latches that enable each connector to be inserted and latched into casing cavities from a mating face of the casing, where the mating face faces the electrical device assembly.

3. The connector of claim 2 characterized in that the terminals are insertable into the electrical connector housings when the housings are mounted to the casing.

4. The electrical connector assembly of claim 1 characterized in that the plurality of electrical connectors are matable with a corresponding plurality of electromagnetic valves mountable in another casing of the electrical device assembly.

5. The electrical connector assembly of claim 4 characterized in that a seal is mounted between the connector casing and a valve casing.

6. The electrical connector assembly of claim 1 characterized in that a cover is mountable to the electrical connector casing, whereby a cover seal is mountable between the cover and casing.

7. The assembly of claim 6 characterized in that the cover seal comprises holes for receiving the wires and slits extending between the periphery of the holes and a side of the seal for assembly of the wires into the holes via the slits.

8. The assembly of any of the preceding claims characterized in that the assembly is a single assembled unit that can be coupled to a single magnet valve assembly comprising a casing, and a corresponding number of magnet valves.

9. The assembly of claim 1 characterized in that the terminals have insulation displacement wire receiving slots, and each connector housing comprises a wire cover fixable to a wire receiving end thereof for retaining wires for connection thereto, in the slots.

10. The assembly of claim 9 characterized in that the wire cover comprises clips to hold the wires thereto, such that the wires can be forced into the slots for electrical contact therewith by mounting the cover to the connector housing until latching means therebetween engage.

* * * * *